United States Patent [19]

Shanley, Jr.

[11] 4,375,174

[45] Mar. 1, 1983

[54] ADJUSTABLE END WRENCH RELEASABLE LOCKING FEATURE

[75] Inventor: Stephen E. Shanley, Jr., Grosse Ile, Mich.

[73] Assignee: Shan-Lok Corporation, Grosse Ile, Mich.

[21] Appl. No.: 295,550

[22] Filed: Aug. 24, 1981

[51] Int. Cl.[3] ..... B25B 13/16; B25B 7/12

[52] U.S. Cl. ..... 81/165; 81/362; 81/315

[58] Field of Search ..... 81/130 R, 165, 170, 81/175, 315, 331, 361, 362

[56] References Cited

U.S. PATENT DOCUMENTS

| | | |
|---|---|---|
| 599,379 | 2/1898 | Billings . |
| 1,403,334 | 1/1922 | McIlvane . |
| 1,490,903 | 4/1924 | Anderson . |
| 1,506,362 | 8/1924 | Carmen . |
| 1,771,692 | 7/1930 | Saunders . |
| 2,539,852 | 1/1951 | McCoy . |
| 3,190,154 | 6/1965 | Chapman . |
| 3,333,492 | 8/1967 | Chapman . |

FOREIGN PATENT DOCUMENTS

| | | |
|---|---|---|
| 1108967 | 1/1956 | France . |
| 553556 | 12/1956 | Italy . |

*Primary Examiner*—James G. Smith

*Attorney, Agent, or Firm*—Sutherland, Asbill & Brennan

[57] ABSTRACT

A thumb adjustable, parallel jaw end wrench, that uses a worm gear and a movable jaw with a rack, is provided with a locking feature. The worm gear is so mounted in the fixed jaw portion of the wrench that it has play in its axial direction. A first hole ("cam follower hole") that extends perpendicularly away from the head end of the gear is intersected by a second hole ("cam pin hole") running perpendicular to the cam follower hole. Biasing means urge the worm gear toward the cam pin hole. A cylindrical pin having a cam surface with high and low positions that extends radially around a central segment of the pin is rotatably mounted in the cam pin hole. Cam follower means slidably mounted in the cam follower hole ride on the cam surface and extend to the head end of the worm gear. To lock the wrench's grip on an object, the pin is turned to its high cam position, causing the follower means to push the gear, and therefore the rack and movable jaw as well, toward the fixed jaw.

27 Claims, 13 Drawing Figures

FIG. 1
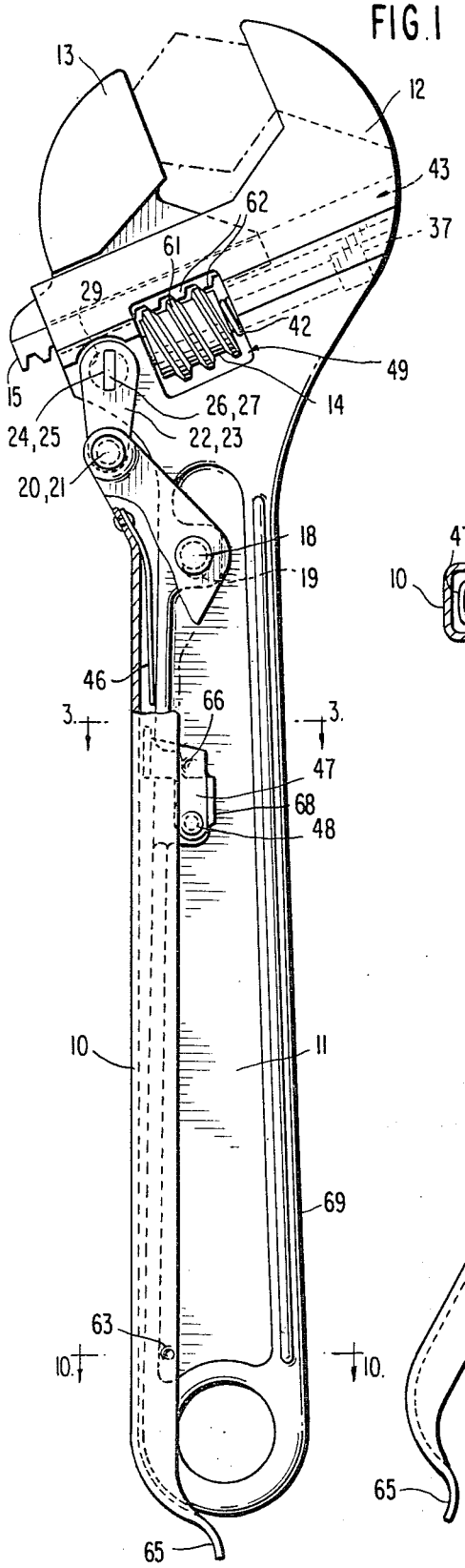
FIG. 2
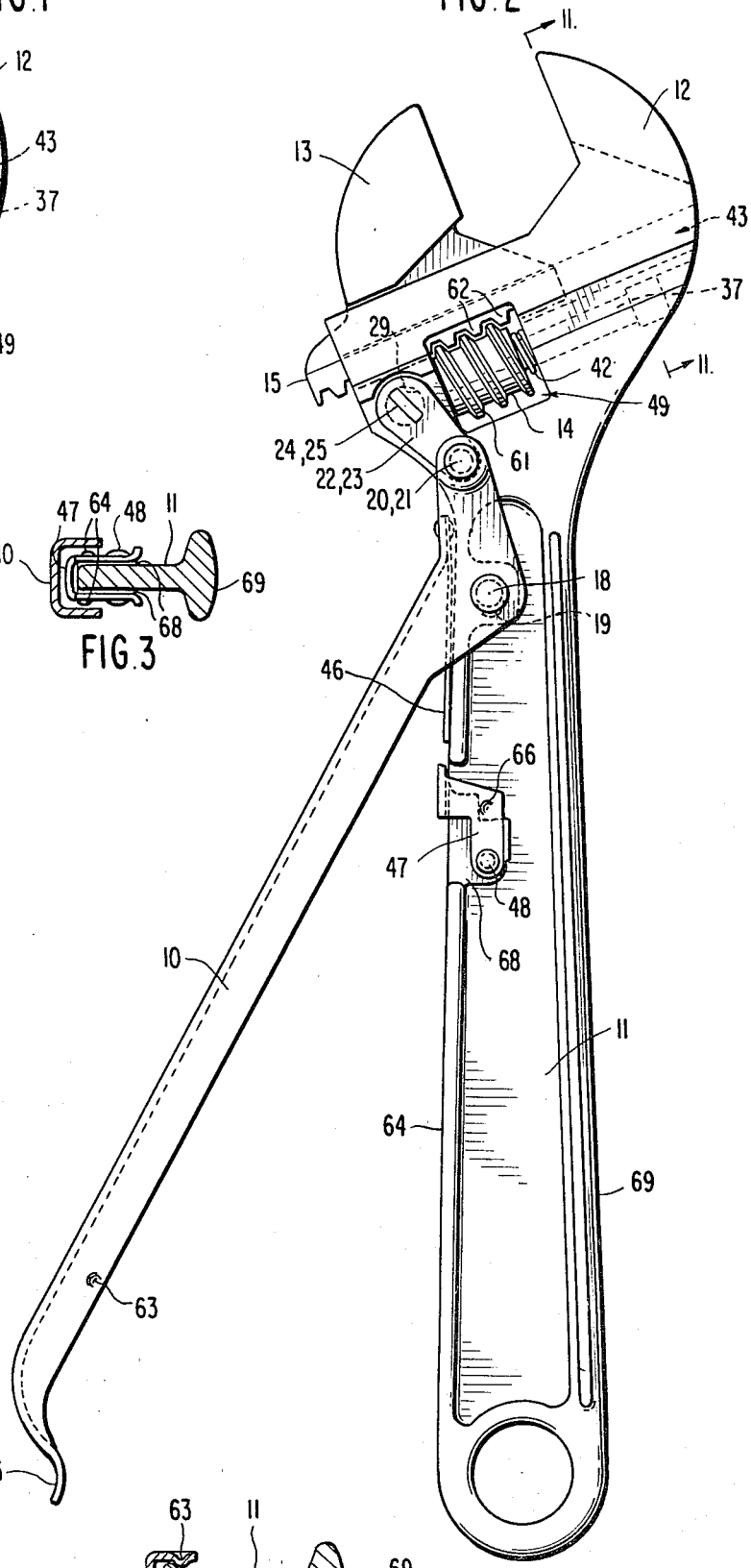
FIG. 3
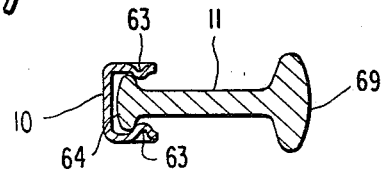
FIG. 10

FIG. 11
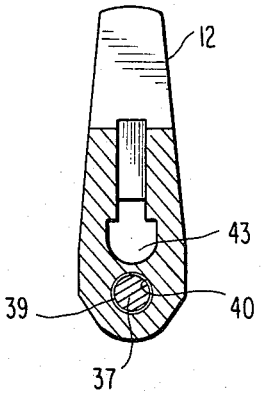
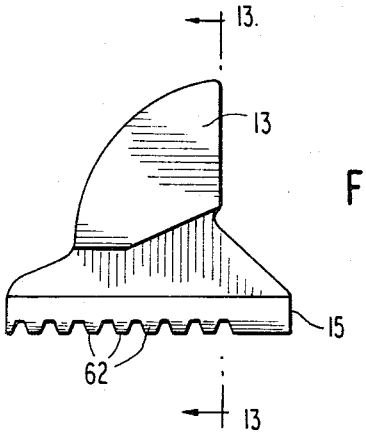
FIG. 12
FIG. 13
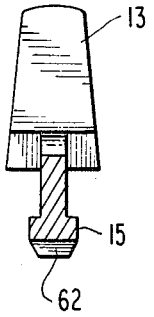

ADJUSTABLE END WRENCH RELEASABLE LOCKING FEATURE

This invention relates to adjustable end wrenches. More particularly it relates to adjustable end wrenches which have worm gear and rack mechanisms for adjusting the distance between the opposed faces of movable and fixed jaws.

Adjustable, parallel jaw end wrenches with worm gear and rack mechanisms have been in general use for probably a hundred years or more. The advantage of such a wrench obviously resides in its ability to take the place of a set of several non-adjustable end wrenches. The adjustable end wrenches have never been a perfect substitute, however, because they tend to back off the object being gripped, especially when a great amount of torque is applied. A stubborn hex head bolt, for example, will often have its corners rounded due to slippage of an adjustable end wrench as one attempts to turn the bolt. Because of the slippage problem, the adjustable, parallel jaw end wrenches in common use today have come to be known as "knuckle busters".

Many attempts have been made over the years to provide adjustable end wrenches with releasable locking mechanisms to prevent them from backing off once they have been tightened on an object. None of the wrenches equipped with such mechanisms appears to have been commercially successful, however. Evidently they have all suffered from one or more of the following drawbacks: too complicated, and therefore too expensive to manufacture; not strong enough to withstand high bending moments; too massive; or requiring too much structural material to be cut away from the wrench, thereby weakening it more than can be tolerated. I have invented a releasable locking mechanism for such a wrench that does not suffer from any of those drawbacks.

The adjustable end wrench which is improved by my locking mechanism is well known in the art. It is comprised of an elongated handle that ends in a fixed jaw portion having a face for engaging one side of an object to be gripped by the wrench; an undercut slot in the fixed jaw portion, the axis of the slot being substantially perpendicular to the plane of the face of the fixed jaw; a movable jaw member having an elongated, protuberant shank portion that mates with the undercut slot and is slidably held in the slot, a face that is opposed to the face of the fixed jaw, and a rack portion that runs parallel to the axis of the slot; an opening, or "window", through the fixed jaw portion adjacent to the slot, the opening being in communication with the slot; and a worm gear rotatably mounted in the opening in driving engagement with the rack portion of the movable jaw member, so that by turning the worm gear one can adjust the distance between the faces of the fixed and movable jaws.

In my improvement the worm gear is so mounted in the opening that there is play in the gear's axial direction. Thinking of the gear as having a head end and a foot end (the rack moving from head to foot as the gear is turned to close the distance between the faces of the fixed and movable jaws) there is a first hole ("cam follower hole") in the fixed jaw portion of my wrench that extends substantially perpendicularly away from the head end of the worm gear. Also, there is a second hole ("cam pin hole") in the fixed jaw portion that intersects the cam follower hole, is substantially perpendicular to the cam follower hole, and extends at least part way through the fixed jaw portion. Biasing means urge the worm gear toward the cam pin hole, and a cylindrical pin having a cam surface that extends radially around a central segment of the pin is rotatably mounted in the hole. The cam surface has a high position at one location along its length and a low position at another location and is aligned with the cam follower hole. Mounted in the cam follower hole and extending from the cam surface to the head end of the worm gear are cam follower means which ride on the cam surface. The cam follower means serve to push the worm gear in a direction away from the cam pin hole when the pin is rotated from the low cam position to the high cam position, thereby taking up at least a portion of the axially directed play in the gear. Finally, the wrench is equipped with crank means for turning the pin back and forth between its low and high cam positions.

The locking mechanism of the wrench of my invention is simple to use. First the cam pin is rotated, using the crank means, until the cam follower is resting at the low cam position. Then the worm gear is turned by thumb until the jaws of the wrench are snug against the object to be gripped. Finally, the crank means are turned to rotate the pin to the high cam position. As the pin rotates, the cam follower means push the worm gear towards its foot end. The worm gear, in turn, pushes the rack in the same direction, thereby shortening the distance between the opposed faces of the fixed and movable jaws, thus tightening the grip on the object being held. Using my locking mechanism, much greater pressure can be generated between the thread (or worm) of the gear and the teeth of the rack than can be produced merely by thumb tightening. As a result, there is greater frictional resistance to the gear turning in the reverse direction, so that the backing off problem of the prior art is overcome.

The locking mechanism of the present invention is inherently strong due to the use of the cylindrical cam pin. The tremendous force that the cam follower exerts against the side of the pin when the wrench is tightly locked is distributed along the entire length of the pin (or substantially so) and is resisted by the stock of the fixed jaw portion of the wrench that lies behind the pin. That portion will ordinarily be one of the thickest parts of the wrench and be made of forged alloy steel. Accordingly, the pin and the material behind it will ordinarily be able to withstand countless applications and releases of the locking mechanism without either of them weakening through metal fatigue.

As stated above, the worm gear is so mounted in the wrench that there is "play" in the gear's axial direction. This is necessary so that the gear has room to move (in the head-to-foot direction) when the cam pin is turned from its low position to its high position. The minimum amount of play necessary is, of course, the difference in height between the low and high cam positions, because that represents the distance the cam follower will slide when the cam pin is turned from the low position to the high position.

Preferably the worm gear will be mounted so that there is at least about 0.005 inch clearance, and most preferably about 0.010 inch or more, between the head end of the gear and the wall of the window when the cam pin is in the unlocked position. If with the passage of time the effective length of the cam follower means should become slightly shorter due to wear, this clearance will assure that the full benefit of the camming action can still be realized.

As stated above, the cam surface is disposed radially on the surface of the pin, going partway around the pin at a central location on the pin. The high and low positions on the cam surface can be either spaced apart or abutting.

~~In~~ perhaps its simplest embodiment the cam pin can be a cylinder with a flat portion cut into its side. The flat portion on the pin will constitute the low cam position and the adjacent round portion will be the high cam position.

Somewhat more complicated, but probably preferred, is the use of shallow and deep detents as the high and low cam positions, respectively. These can be formed for example, by cutting slightly overlapping concave depressions in the pin, using a ball nose cutter. The line of centers of the two depressions is to be perpendicular to the axis of the pin, and, as already indicated, one depression is to be deeper than the other.

The preferred difference in height between the low and high positions on the cam surface of the pin will depend on the size of the wrench. Often it will be preferred, especially for wrenches ranging from about 8 to 10 inches in length, that the difference in height be about 0.010 to 0.050 inch. A narrower preferred range might be about 0.015 to 0.035 inch.

The preferred diameter of the cam pin also depends on the size of the wrench. For 8 to 10 inch wrenches it is preferably at least about $\frac{1}{8}$ inch, e.g., in the range of about 7/32 to $\frac{3}{8}$ inch.

A preferred means of mounting the worm gear is by use of stub shafts at both ends. By "stub shaft" is meant any of various infixed pieces (as a stud, rod, or pin) which projects from or into the end of the worm gear and serves as a support and axis for the gear, as distinguished from a single axle that passes all the way through a center shaft in the gear. By using mounting means at both ends, rather than one end only, the worm gear is provided with outstanding support and alignment. With respect to the head end of the gear, for example, if the cam follower hole in the fixed jaw portion is cylindrical and is aligned with the axis of the worm gear, a stub shaft that is integral with the head end of the worm gear can be rotatably mounted in the cam follower hole and can also function as part or all of the cam follower means. The foot end of such a gear can advantageously have an axial, cylindrical recess in it, and that recess can be rotatably fitted over a second stub shaft that projects into the window from the fixed jaw portion to the wrench. For ease of assembly, the foot end stub shaft can be a partially threaded, cylindrical rod inserted from outside the wrench through a complementary, partially threaded hole.

Numerous other mounting arrangements for the worm gear will be readily apparent to those skilled in the art.

The cam follower means can be composed of a single part or a plurality of components. As stated above, for example, a stub shaft projecting from the head end of the worm gear can serve also as the cam follower means. Alternatively, a loose pin slidably mounted in the cam follower hole can function as the cam follower means. Such a pin can abut the end of a stub shaft that is integral with the worm gear or, alternatively, it can extend into an axial recess in the head end of the gear to help hold the gear in place.

The cam follower means preferably end in a rounded surface that rides against the cam surface of the pin. A ball nose pin or stub shaft can be used, for example, or, more preferably, a ball bearing that is rotatably mounted in the cam follower hole.

Ideally, if a ball bearing is used as the contact end of the cam follower means, it will be used in conjunction with a loose pin or a head end stub shaft that has a concave end that mates with the ball bearing. The preferred cam follower means are a stub shaft that is integral with the head end of the worm gear and has a concave end, in combination with a ball bearing that mates with the concave end of the shaft and is rotatably mounted in the cam follower hole, the ball bearing being sandwiched between the end of the stub shaft and the surface of the cam. Use of a rotatably mounted ball bearing as the contact end of the cam follower means makes it easier to lock and unlock the wrench, reduces the wear on the pin and the cam follower means, and minimizes the chances of the stub shaft or pin breaking under the forces generated when engaging the locking mechanism. Also, by using a ball bearing one can reserve the hardest steel for that component alone, for which exceptional hardness is most needed, rather than incur the greater cost of fabricating the entire cam follower means of high hardness steel.

Various biasing means can be used to urge the worm gear toward the hole in the fixed jaw portion. Bellville washers or coil springs, for example, can be used. In a preferred embodiment a compressed spring is located between the foot end of the worm gear and the wall of the opening in the fixed jaw portion. Alternatively, if the foot end of the worm gear has an axial recess which is fitted over a stub shaft carried by the fixed jaw portion, a spring can be positioned in the recess, compressed between the end of the stub shaft and the bottom of the recess. Also, of course, springs at both locations can be used.

Numerous other biasing means for the worm gear will be readily apparent to those skilled in the art.

The cam pin hole in the fixed jaw portion of the wrench is preferably cylindrical. It is also preferred that the hole extend all the way through the wrench, so that radial arms can be rigidly attached to the opposite ends of the pin as part of the crank means for rotating the pin. A hand-operated lever should be connected to the arms, either rigidly or through a linkage arrangement. It is preferred that the lever, the arms and the pin be so interconnected that when the cam follower means is resting on the high cam position (i.e., the wrench is in the locked position) the lever is parallel to, and lays against, the handle of the wrench.

Preferably, the locking lever will be connected through four bar linkage arrangements with the arms that turn the cam pin. Such arrangements are well known in the art and may involve, for example, the use of toggle linkages or sliding pivots. For example, the lever can be mounted at its fulcrum to the wrench handle via a sliding pivot, and the short end of the lever can be pivotably attached to the ends of the radial arms that extend from the cam pin. This results in a four bar linkage that causes the cam pin to rotate clockwise as the lever is turned counterclockwise. In such an arrangement it is preferred that the linkage be so dimensioned that the floating pivot (the lever-to-arm connection) will be on one side of the line of centers from the cam pin to the sliding pivot when the cam follower rests on the low cam position, and on the opposite side of that line when the cam follower is at the high cam position.

The locking lever may advantageously have a U-shaped cross-section, with the opening of the U facing one edge of the handle of the wrench. In this way the lever can overlap the handle and fit snugly against it when the wrench is in the locked position.

In the lever arrangement described above it is also preferred to have some biasing means that help push the lever away from the wrench handle when the jaws are being unlocked. A leaf spring mounted either on the edge of the handle or on the underside of the lever, for example, can be used for that purpose.

In the lever arrangement described above the jaws of the wrench are gradually tightened as the lever is squeezed toward the handle. As an optional feature, the wrench may have disengageable stop means for preventing the lever from being squeezed past the point where the cam follower means has ridden part way out of the low cam position, but has not yet reached the full height of the high cam position. Such a feature is useful, for example, where the wrench is to be used for a rapid succession of short turns for which a fully locked grip is unnecessary. Such stop means may, for example, take the form of a brace member, or stop wedge, the end of which is pivotably connected to the wrench handle, so that when the stop wedge is swung out from the handle to a ninety degree angle it will block the lever from closing. When the stop wedge is swung closed, it should lie flat against the handle, or in a recess in the handle, so as not to obstruct the lever from closing.

The cam follower hole in the fixed jaw portion, which extends substantially perpendicularly from the head end of the worm gear, can either terminate at the point where it intersects the cam pin hole, or it can extend beyond, passing all the way through the fixed jaw portion of the wrench. The choice depends primarily on how the worm gear is to be mounted in the window.

Preferably, the gear will be held in the window, at least in part, by inserting a shaft for the gear (stub shaft or through shaft) through a hole in either the head end or the foot end of the fixed jaw portion. As discussed earlier, in a preferred embodiment a partially threaded pin is inserted through a partially threaded hole in the foot end of the fixed jaw portion to provide a stub shaft projection into the foot end of the window. Using that mounting arrangement, it is preferred to have the cam follower hole terminate at, rather than cross, the cam pin hole. In this manner the back wall of the cam pin hole, i.e., the wall opposite the cam follower means, can be kept smooth and unbroken, thereby providing maximum support for the cam pin when it is subjected to the forces of locking.

If a shaft is instead inserted through a hole on the head end side of the fixed jaw, then that hole will preferably be coaxial with the cam follower hole. In that embodiment there will be, in effect, only one long hole, interrupted by the cam pin hole, that extends from the window to the outside edge of the fixed jaw portion. Where the last-mentioned arrangement is used, additional support can be provided for the cam pin by filling that portion of the shaft hole that extends from the outside edge of the wrench to the back wall of the cam pin hole. A set screw, for example, may be used as the filler piece.

My invention will be better understood by studying the enclosed drawings, a discussion of which now follows.

FIG. 1 is a side view of a preferred embodiment of the wrench of the present invention, shown in the fully locked position.

FIG. 2 is a side view of the wrench depicted in FIG. 1, but shown in the unlocked position.

FIG. 3 is a sectional view (slightly enlarged) of FIG. 1, taken along the line 3—3.

FIG. 10 is a slightly enlarged sectional view of FIG. 1, taken along the line 10—10.

FIG. 11 is a sectional view of FIG. 2, taken along the line 11—11.

FIG. 12 is a side view of the movable jaw of the wrench as shown in FIGS. 1 and 2.

FIG. 13 is a sectional view of FIG. 12, taken along the line 13—13.

Figure 4:
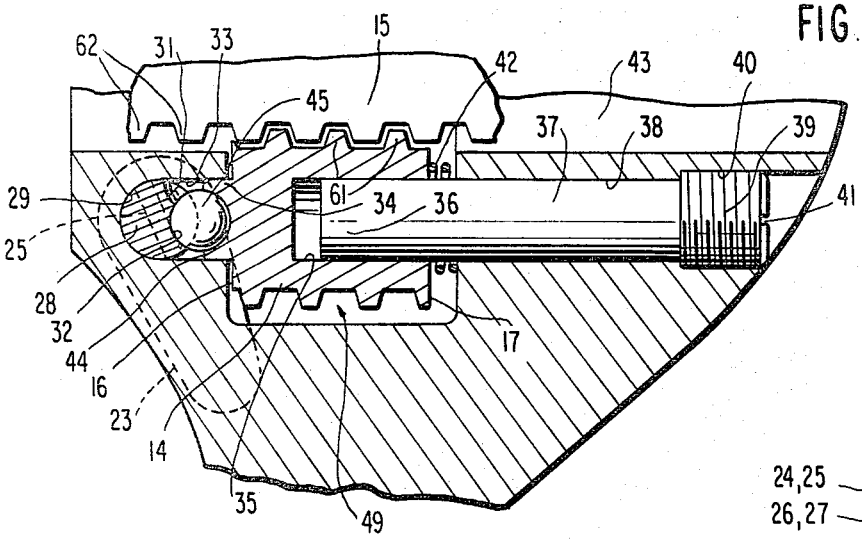
FIG. 4 is an enlarged, fragmentary view, in partial section, of the locking mechanism of the wrench in the unlocked position, as depicted in FIG. 2.
Figure 6:
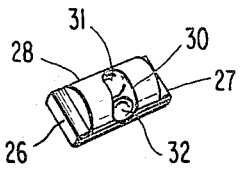
FIG. 6 is a perspective view of the cam pin included in the mechanism depicted in FIGS. 4 and 5.

The wrench shown in FIGS. 1 through 7 and 10 through 13 of the drawings is designed to be used as follows:

First, lever 10 is swung away from handle 11. The object to be held is then positioned between the opposed faces of fixed jaw portion 12 and movable jaw 13, while handle 11 is grasped in the hand. Movable jaw 13 has an elongated, protuberant shank 15 that mates with, and is slidably held in, undercut slot 43 in fixed jaw portion 12. Shank 15 has a rack portion formed of teeth 62 cut into it which meshes with thread 61 of worm gear 14. Worm gear 14 is turned with the thumb so that shank 15 of movable jaw 13 moves in undercut slot 43 of fixed jaw portion 12 in the direction from the head end 16 of worm gear 14 to the foot end 17 of that gear.

When worm gear 14 has been sufficiently turned with the thumb that the opposed faces of jaws 12 and 13 are snug against the object, the wrench can be locked by squeezing lever 10 closed against handle 11. As that is done, fulcrum pin 18 slides in slot 19, and floating pivots 20 and 21, which connect the short end of lever 10 to radial arms 22 and 23, are swung in a direction away from opening 49 in the fixed jaw portion 12 of the wrench. Arms 22 and 23 have slots 24 and 25 in them, which fit over keys 26 and 27 in the opposite ends of cam pin 28. Therefore, as arms 22 and 23 turn, cam pin 28 is rotated in cam pin hole 29.

Milled into the surface of cam pin 28 in its center segment is a cam surface (shown generally as 30) which at one end has a high position detent 31 and at the other end a low position detent 32. Cam surface 30 is aligned with cam follower hole 33. When lever 10 is swung fully away from handle 11, low position detent 32 faces cam follower hole 33. When lever 10 is squeezed all the way closed against handle 11, high position detent 31 faces cam follower hole 33.

The head end 16 of worm gear 14 has stub shaft 34 projecting from it, and that shaft is rotatably mounted in cam follower hole 33. Foot end 17 of the gear has a cylindrical recess 35 which is mounted over stub shaft 36. Stub shaft 36 is the protruding end of pin 37. Pin 37 is held in hole 38 in the fixed jaw portion 12 by male threads 39 on the external end of pin 37 and complementary female threads 40 at the outside end of hole 38. The external end of pin 37 has a screwdriver slot 41 in it to permit pin 37 to be screwed into hole 38.

Compressed coil spring 42 is carried by stub shaft 36 in the gap between the foot end 17 of worm gear 14 and the wall of opening 49. Spring 42 constantly urges gear 14 toward cam pin hole 29.

Figure 5:
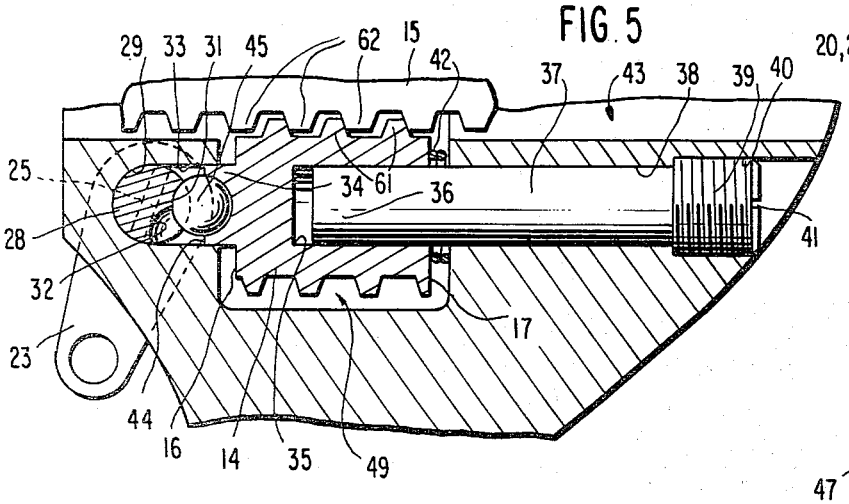
FIG. 5 is an enlarged, fragmentary view, in partial section, of the locking mechanism in the locked position, as depicted in FIG. 1.

The end 44 of stub shaft 34 is concave and mates with ball bearing 45, which is rotatably mounted in cam follower hole 33. Bearing 45 rides against cam surface 30 and mates with both concave detents 31 and 32, but one at a time. As lever 10 is squeezed toward handle 11, causing cam pin 28 to rotate, bearing 45 rolls out of low position detent 32 (FIG. 4) and rides up into high position detent 31 (FIG. 5). As it does so, worm gear 14 is forced to slide toward its foot end 17. If worm gear 14 had been thumb-tightened before lever 10 was squeezed closed against handle 11, the thread 61 of gear 14 will push against the teeth 62 of the rack portion of the shank 15 of movable jaw 13, thereby tightening the grip of jaws 12 and 13 on the object being held.

Figure 7:
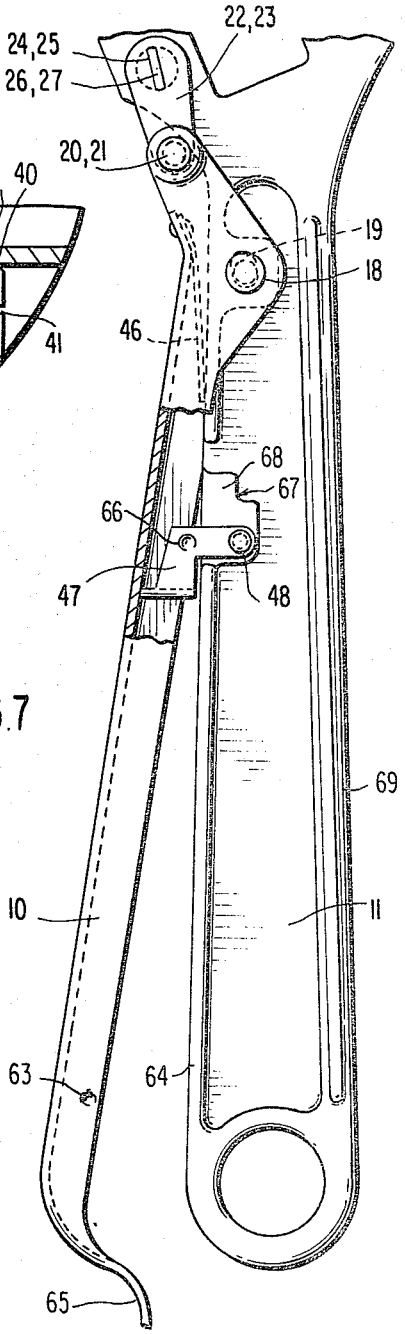
FIG. 7 is a partial view of the lever, crank, and handle portions of the wrench depicted in FIGS. 1-3, but showing the lever in an intermediate position, between unlocked and locked.

Stop wedge member 47 is pivotably attached by pin 48 to handle 11. When it is desired to use the wrench in just a partial tightening mode, stop wedge member 47 is swung out to a 90 degree angle from handle 11, as shown in FIG. 7. In that position stop wedge member 47 will prevent lever 10 from closing all the way against handle 11. Stop wedge member 47 is long enough that it will hold lever 10 a sufficient distance off from handle 11 that ball bearing 45 will not reach locking position detent 31. By designing cam surface 30 so that there is a slope between low position detent 32 and high position detent 31, worm gear 14 and movable jaw 13 will have been pushed some distance in the head-to-foot direction by the time stop wedge member 47 halts the closing of lever 10 against handle 11, but not as far as when lever 10 is completely closed against handle 11. That effects a partial tightening only of jaws 12 and 13 on the object being held. The partial tightening can be released simply by relaxing one's grip on lever 10 and handle 11, causing spring 46 to urge lever 10 back to the fully open position (FIG. 2), thereby causing bearing 45 to ride back down the cam surface 30 into low position detent 32.

Stop wedge member 47 contains a pair of detents 66, which nest behind inside corners 67 of a pair of flat pads 68 which are raised portions in the center web (one on each side) of handle 11. Detents 66 help hold stop wedge member 47 in the closed position when not in use.

In order to unlock the wrench shown in FIGS. 1 through 7, lever 10 is simply swung away again from handle 11. Leaf spring 46, which is mounted on the underside of lever 10, tends to push lever 10 and handle 11 apart, thereby assisting the unlocking action.

Lever 10 is provided with a pair of detents 63 which nest behind the opposite sides of flanged bottom edge 64 of handle 11 when the wrench is in the locked position (FIG. 1), thereby helping to hold lever 10 closed against the force of leaf spring 46 when nothing is being locked between the jaws. When an object is being held in the locked position leaf spring 46 does not have sufficient force to overcome the locking force and unlock the wrench.

As shown in FIGS. 1, 2 and 7, lever 10 may project beyond the end of handle 11. The projecting portion 65 facilitates unlocking the wrench by using only the hand in which the wrench is held. By pressing the ham of that hand against projecting portion 65, lever 10 can easily be pushed away from handle 11.

As shown in FIGS. 3 and 10, the flanged top edge 69 of handle 11 is wider than the bottom edge 64. The extra width of edge 69 provides greater comfort for the palm of the hand when turning the wrench.

Figure 8:
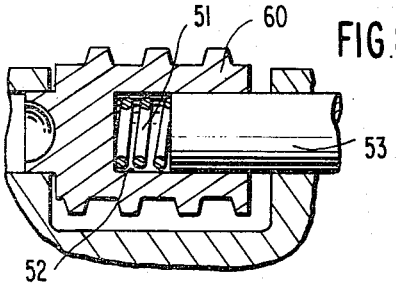
FIG. 8 is a fragmentary view in partial section of an alternative arrangement of the worm gear shown in FIGS. 4 and 5.

In FIG. 8 first alternative biasing means for the worm gear are shown. There a coil spring 51 is mounted in axial recess 52 in the foot end of worm gear 60, where it is compressed between the bottom of recess 52 and the end of stub shaft 53.

Figure 9:
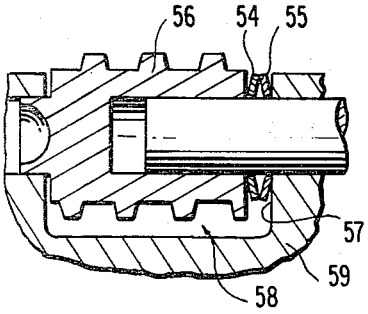
FIG. 9 is a fragmentary view in partial section of a second alternative arrangement of the worm gear shown in FIGS. 4 and 5.

FIG. 9 depicts a second alternative mounting arrangement for the biasing means. Bellville washers 54 and 55 are compressed between the foot end of gear 56 and the wall 57 of opening 58 in fixed jaw portion 59.

I claim:

1. In an adjustable end wrench comprised of an elongated handle that ends in a fixed jaw portion having a face for engaging one side of an object to be gripped by the wrench;

an undercut slot in the fixed jaw portion, the axis of the slot being substantially perpendicular to the plane of the face of the fixed jaw;

a movable jaw member having (a) an elongated, protuberant shank portion that mates with the undercut slot and is slidably held in said slot, (b) a face that is opposed to the face of the fixed jaw, and (c) a rack portion that runs parallel to the axis of the slot;

an opening through the fixed jaw portion adjacent the slot, said opening being in communication with the slot;

and a worm gear rotatably mounted in the opening in driving engagement with the rack portion of the movable jaw member, so that by turning the worm gear one can adjust the distance between the faces of the fixed and movable jaws, said gear having a head end and a foot end, the rack moving from head to foot as the gear is turned to close the distance between the faces of the fixed and movable jaws;

the IMPROVEMENT wherein, the worm gear is so mounted in the opening that there is play in the gear's axial direction, and wherein the wrench further includes a first hole in the fixed jaw portion that extends substantially perpendicularly away from the head end of the worm gear;

a second hole in the fixed jaw portion that intersects the first hole, is substantially perpendicular to the first hole, and extends at least part way through the fixed jaw portion;

biasing means that urge the worm gear toward the second hole;

a cylindrical pin rotatably mounted in the second hole, the pin having a cam surface extending radially around a central segment of the pin, said cam surface being aligned with the first hole and having a high position at one location and a low position at another location;

cam follower means mounted in the first hole, riding on the cam surface, and extending from the cam surface to the head end of the worm gear, said cam follower means serving to push the worm gear in a direction away from the second hole when the pin is rotated from the low cam position to the high cam position, thereby taking up at least part of the axially directed play in the gear;

and crank means for turning the pin back and forth between its low cam position and its high cam position.

2. The improvement of claim 1 wherein the first and second holes are cylindrical and the first hole is aligned with the axis of the worm gear, and the cam follower means include a cylindrical stub shaft that is integral with the worm gear and is rotatably mounted in the first hole.

3. The improvement of claim 1 wherein that portion of the cam follower means that contacts the cam surface is a ball bearing that is rotatably mounted in the first hole.

4. The improvement of claim 2 wherein that portion of the cam follower means that contacts the cam surface is a ball bearing that is rotatably mounted in the first hole.

5. The improvement of claim 4 wherein the end of the stub shaft is concave and mates with, and rides against the surface of, the ball bearing.

6. The improvement of any of claims 3, 4, or 5 wherein the low and high cam positions in the cam surface of the pin are both concave detents that mate with the surface of the ball bearing.

7. The improvement of claim 1 wherein the difference in height between the low cam and high cam positions in the cam surface of the pin is about 0.010 to 0.050 inch.

8. The improvement of claim 5 wherein the difference in height between the low cam and high cam positions in the cam surface of the pin is about 0.010 to 0.050 inch.

9. The improvement of claim 8 wherein the low and high cam positions in the cam surface of the pin are both concave detents that mate with the surface of the ball bearing.

10. The improvement of claim 1 wherein the foot end of the worm gear has an axial, cylindrical recess therein and is rotatably fitted over a cylindrical stub shaft that projects from the fixed jaw portion into the opening in the fixed jaw portion.

11. The improvement of claim 10 wherein the biasing means is a coil spring that is slidably mounted on the stub shaft that projects from the fixed jaw portion, said spring being compressed between the wall of the opening and the foot end of the worm gear.

12. The improvement of claim 2 wherein the foot end of the worm gear has an axial, cylindrical recess therein and is rotatably mounted on a cylindrical stub shaft that projects from the fixed portion into the opening in the fixed jaw portion.

13. The improvement of claim 5 wherein the foot end of the worm gear has an axial, cylindrical recess therein and is rotatably mounted on a cylindrical stub shaft that projects from the fixed jaw portion into the opening in the fixed jaw portion.

14. The improvement of claim 12 wherein the biasing means is a coil spring that is slidably mounted on the stub shaft that projects from the fixed jaw portion, said spring being compressed between the wall of the opening and the foot end of the worm gear.

15. The improvement of claim 13 wherein the biasing means is a coil spring that is slidably mounted on the stub shaft that projects from the fixed jaw portion, said spring being compressed between the wall of the opening and the foot end of the worm gear.

16. The improvement of claim 1 wherein the second hole in the fixed jaw portion extends all the way through the fixed jaw portion, and the crank means include radial arms rigidly attached to the opposite ends of the pin, said arms being connected to a hand-operated lever by which the arms and the pin can be rotated.

17. The improvement of claim 16 wherein the lever, the arms, and the pin are so interconnected that when the cam follower means are resting on the high cam position on the pin, the lever is parallel to, and lays against, the handle of the wrench.

18. The improvement of claim 9 wherein the second hole in the fixed jaw portion extends all the way through the fixed jaw portion, and the crank means include radial arms rigidly attached to the opposide ends of the pin, said arms being connected to a hand-operated lever by which the arms and the pin can be rotated.

19. The improvement of claim 18 wherein the lever, the arms, and the pin are so interconnected that when the cam follower means are resting on the high cam position on the pin, the lever is parallel to, and lays against, the handle of the wrench.

20. The improvement of claim 19 wherein the foot end of the worm gear has an axial, cylindrical recess therein and is rotatably fitted over a cylindrical stub shaft that projects from the fixed jaw portion into the opening in the fixed jaw portion.

21. The improvement of claim 20 wherein the biasing means is a coil spring that is slidably mounted on the stub shaft that projects from the fixed jaw portion, said spring being compressed between the wall of the opening and the foot end of the worm gear.

22. The improvement of claim 21 wherein the high and low cam positions in the cam segment are concave detents that mate with the surface of the ball bearing.

23. The improvement of claim 22 wherein the difference in height between the low cam and high cam positions in the cam surface of the pin is about 0.015 to 0.035 inch.

24. The improvement of claim 23 wherein the foot end of the worm gear has an axial, cylindrical recess therein and is rotatably fitted over a cylindrical stub shaft that projects from the fixed jaw portion into the opening in the fixed jaw portion.

25. The improvement of claim 24 wherein the biasing means is a coil spring that is slidably mounted on the stub shaft that projects from the fixed jaw portion, said spring being compressed between the wall of the opening and the foot end of the worm gear.

26. The improvement of claim 25 wherein the second hole in the fixed jaw portion extends all the way through the fixed jaw portion, and the crank means include radial arms rigidly attached to the oppostie ends of the pin, said arms being connected to a hand-operated lever by which the arms and the pin can be rotated.

27. The improvement of claim 26 wherein the lever, the arms, and the pin are so interconnected that when the cam follower means are resting on the high cam position on the pin, the lever is parallel to, and lays against, the handle of the wrench.

* * * * *